US007150071B2

(12) United States Patent
Collene et al.

(10) Patent No.: US 7,150,071 B2
(45) Date of Patent: Dec. 19, 2006

(54) BREAKAWAY HINGE SYSTEM FOR APPLIANCE DOOR

(75) Inventors: James J. Collene, Bucyrus, OH (US); Jeffrey D. Habegger, Wadsworth, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 94 days.

(21) Appl. No.: 10/379,750

(22) Filed: Mar. 5, 2003

(65) Prior Publication Data

US 2004/0172787 A1 Sep. 9, 2004

(51) Int. Cl.
*E05F 1/08* (2006.01)

(52) U.S. Cl. ..... 16/289; 16/223; 16/306; 126/192; 126/194

(58) Field of Classification Search ..... 16/223, 16/289, 306, 305, 343; 49/386, 387; 126/194, 126/192, 190
See application file for complete search history.

(56) References Cited

U.S. PATENT DOCUMENTS 3,712,287 A * 1/1973 Summers, Jr. ..... 126/191
3,955,865 A * 5/1976 Wilson ..... 126/191
4,665,892 A * 5/1987 Spargo et al. ..... 126/194
5,291,634 A 3/1994 Zanetti
5,341,542 A 8/1994 Hannan et al.
6,453,510 B1 * 9/2002 Cummins et al. ..... 16/343

* cited by examiner

*Primary Examiner*—Brian E. Glessner
*Assistant Examiner*—Mark Williams
(74) *Attorney, Agent, or Firm*—Fay, Sharpe, Fagan, Minnich & McKee, LLP

(57) ABSTRACT

A breakaway hinge system for an appliance door includes a claw and a receptacle adapted to receive and retain the claw. The receptacle includes a support member and at least one hinge mounting structure that is engaged by the claw. The at least one hinge mounting structure is movable relative to the support member between first and second positions. A spring biases the at least one hinge mounting structure to the first operative position, and the at least one hinge mounting structure is movable to the second position in response to application of force to the hinge assembly having a magnitude sufficient to overcome the spring. The at least one hinge mounting structure can be a pin or like structure provided as part of a pair of pins connected directly or indirectly to the support member.

12 Claims, 11 Drawing Sheets

FIG. 6C
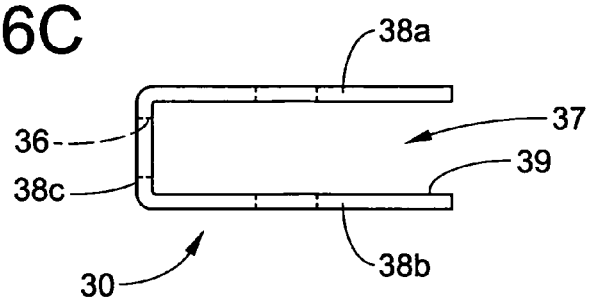
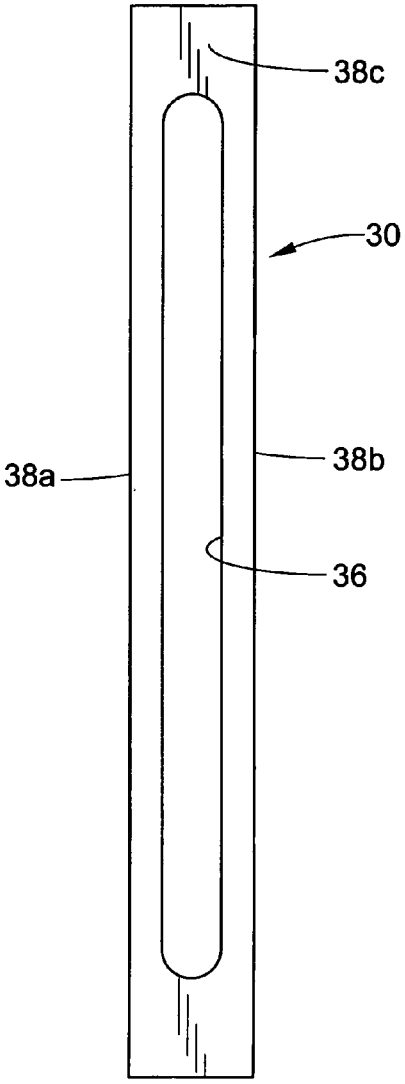
FIG. 6B
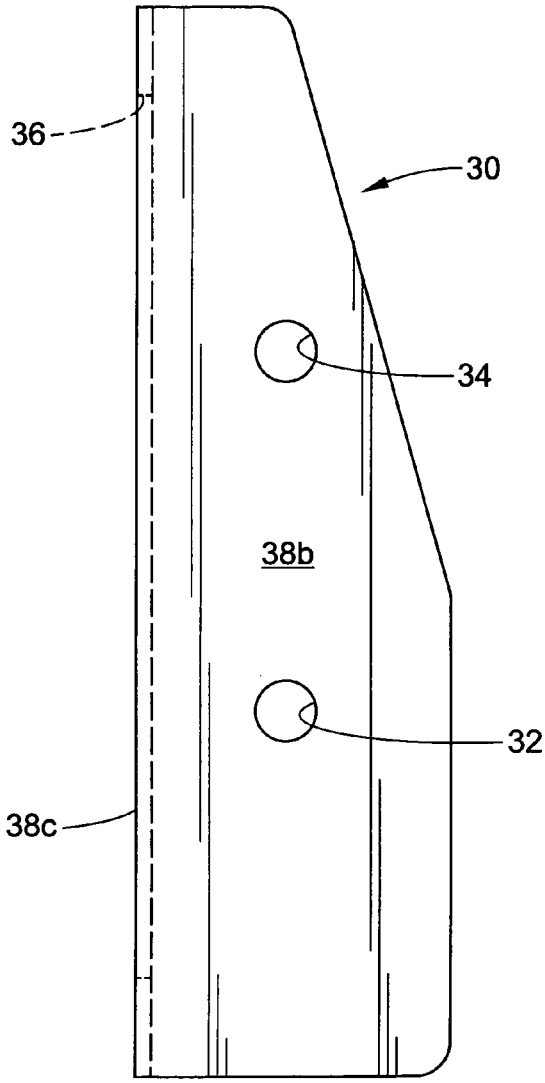
FIG. 6A

BREAKAWAY HINGE SYSTEM FOR APPLIANCE DOOR

BACKGROUND OF THE INVENTION

Damage to appliances and the hinges and doors thereof commonly occurs when the door is moved beyond its intended full-open position by placement of excessive weight on the door or by manual force through inappropriate use. Another drawback to attempted movement of an appliance door beyond its intended full-open position during improper use of the appliance is the possibility that the appliance can tip forward.

In light of the foregoing, a need has been identified for a breakaway hinge system for appliance doors that prevents or at least reduces the likelihood of damage to the appliance, its door and hinges upon movement or attempted movement of the door beyond its full-open position.

SUMMARY OF THE INVENTION

In accordance with a first aspect of the invention, a receptacle for mounting a hinge assembly includes a support member and a second member movably connected to the support member. The second member is movable relative to said support member between first and second positions. At least one hinge mounting structure is connected to the second member for movement therewith relative to said support member. The at least one hinge mounting structure is adapted for connection to an associated hinge assembly. A spring normally biases the second member to its first position.

In accordance with another aspect of the present invention, a breakaway hinge system for an appliance door is provided. The hinge system includes a claw and a receptacle adapted to receive and retain the claw. The receptacle includes a support member and at least one hinge mounting structure that is engaged by the claw. The at least one hinge mounting structure is movable relative to the support member between first and second positions. A spring biases the at least one hinge mounting structure to the first operative position, and the at least one hinge mounting structure is movable to the second position in response to application of force to the hinge assembly having a magnitude sufficient to overcome the spring.

In accordance with another aspect of the present invention, a breakaway hinge system for an appliance door includes a support member and a hinge mounting structure connected to the support member. The hinge mounting structure is movable between first and second positions. The hinge mounting structure is adapted to be engaged and retained by associated hinge assembly. A spring exerts a biasing force on the hinge mounting structure to bias the hinge mounting structure to its first position. The hinge mounting structure is selectively movable to the second position against the biasing force of said spring.

In accordance with a further aspect of the present invention, a receptacle for mounting a hinge assembly to an appliance includes first and second mounting structures to be engaged by an associated hinge assembly. The second mounting structure is movable between first and second positions. A spring biases the second mounting structure toward the first position, and the second mounting structure is movable from the first position toward the second position when a breakaway force is applied to the hinge assembly in a magnitude sufficient to overcome a biasing force of the spring.

BRIEF DESCRIPTION OF THE DRAWINGS

The invention comprises various components and arrangements of components, preferred embodiments of which are illustrated in the accompanying drawings that form a part hereof and wherein:

FIGS. 6A–6C show side elevational, rear elevational and top plan views of the inner hinge pocket member of the pivoting receptacle assembly shown in FIGS. 2A–2C;

DETAILED DESCRIPTION OF PREFERRED EMBODIMENTS

Figure 1:
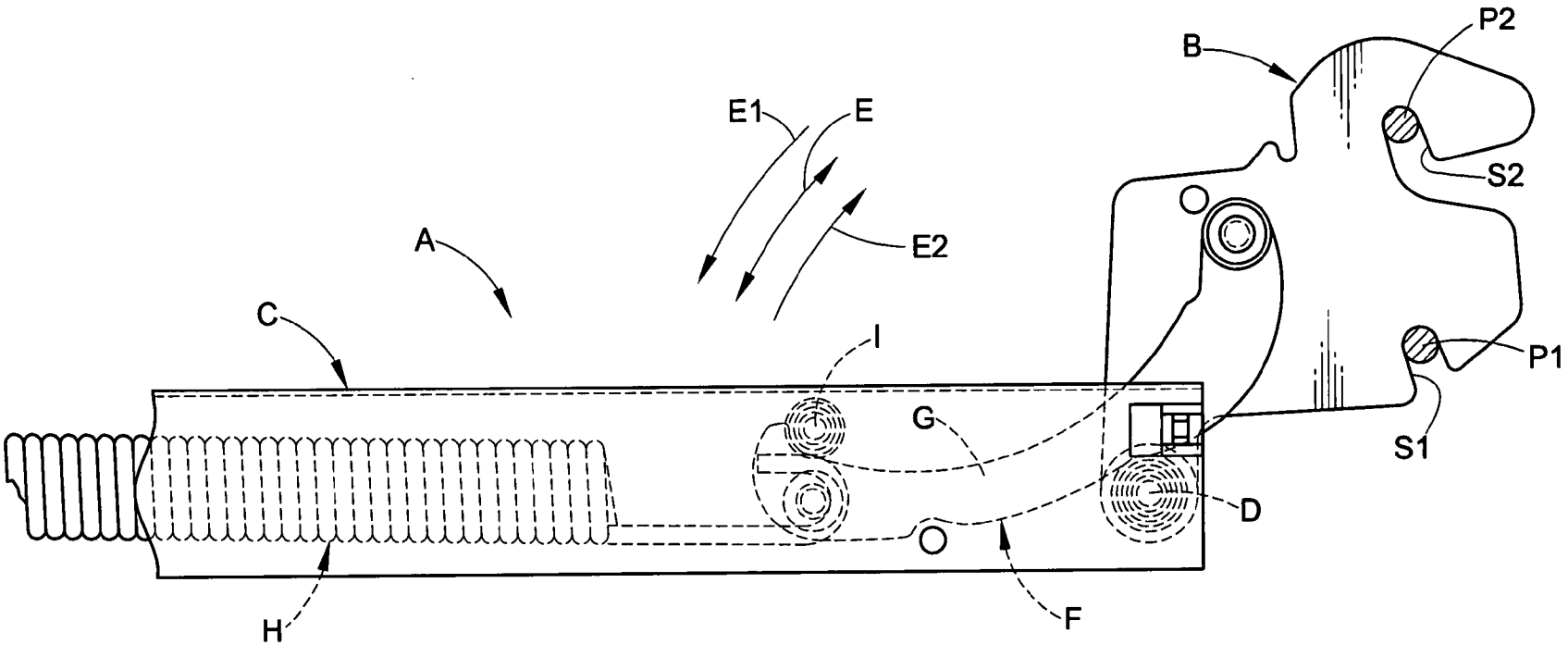
FIG. 1 (PRIOR ART)
FIG. 1 illustrates a conventional (prior art) hinge assembly and first and second mounting pins of an oven or other appliance to which the hinge assembly is connected.

FIG. 1 illustrates a conventional hinge assembly A that includes a claw B adapted for connection to a frame or chassis of an appliance such as a oven or any other appliance via first and second pins P1,P2 that are connected to the appliance frame. The hinge assembly A further comprises a channel member C (typically a U-shaped or C-shaped member) having a first end pivotally connected to the claw B at a pivot point D so that the channel is adapted for movement on an arc E relative to the claw B. Typically, the channel C is connected to an appliance door such as an oven door that closes an access opening of the appliance.

The claw B and the channel C are also operably interconnected through a link assembly F. The link assembly F comprises one or more link members G that are pivotally connected at their first ends to the claw B. The one or more link members G are connected at an opposite, second end to the first end of a coil spring H by way of a transversely extending rivet or other fastener L. The opposite, second end of the coil spring H is secured to fixed point such as an opposite end of the channel C or a member connected thereto. A roller or bushing I spans the channel C and the one or more links G engage same when the channel C is pivoted relative to the claw B. When the channel C is pivoted as far as possible in the direction E1 on the arc E to a first operative position as shown in FIG. 1 (corresponding to a fully-opened position of the appliance door connected to the channel C), the roller I is received in a dwell point of the link(s) G as shown and the channel cannot be pivoted further in the direction E1, and further attempted movement of the channel C in the direction E1 will result in damage to the hinge assembly A and/or tipping of the appliance to which the hinge assembly A is connected. From the position illustrated in FIG. 1, the channel C can be pivoted in the opposite direction E2 on the arc E to a second operative position (corresponding to a fully-closed position of the appliance door connected to the channel C). The coil spring H, roller I, fastener L and links F are at least partially housed within the recess of the channel C as indicated by the broken lead lines, but some of these components are shown in solid lines in the drawings for clarity, and the same technique is used in connection with the drawings discussed below.

As shown in FIG. 1, the claw B includes first and second slots S1,S2 that receive and retain first and second pins P1,P2 that are connected to the appliance to which the hinge assembly A is connected. In conventional arrangements such as that shown in FIG. 1, the pins P1,P2 (which can be pins, rivets or the like) are fixed in position relative to each other.

Figure 2A:
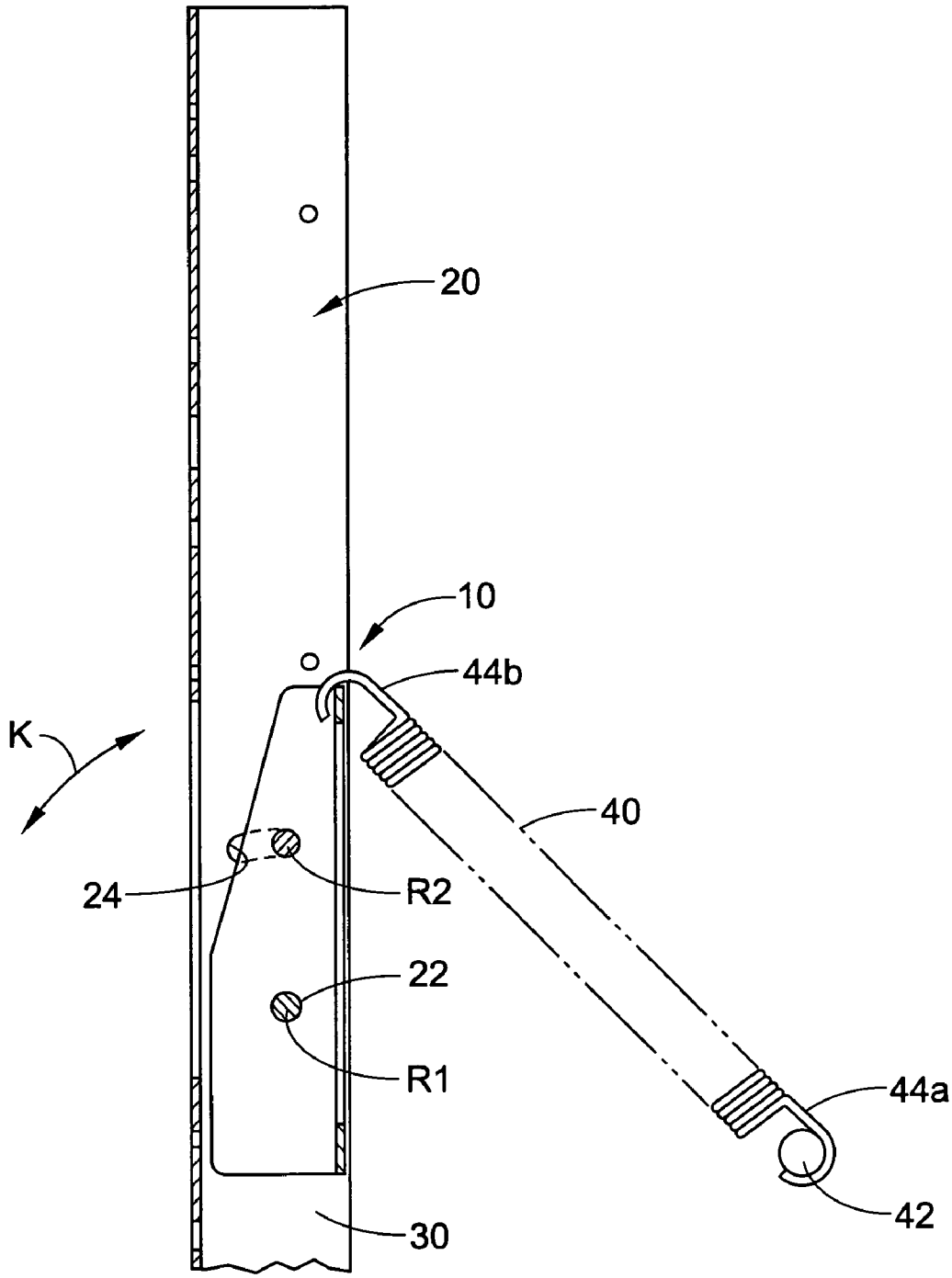
FIGS. 2A–2C illustrate a pivoting hinge receptacle assembly formed in accordance with the present invention and to which a conventional hinge is connected, with FIG. 2A showing the receptacle assembly in a first or home (non-pivoted) position and FIGS. 2B and 2C showing the receptacle assembly in a second (pivoted) position.
Figure 2B:
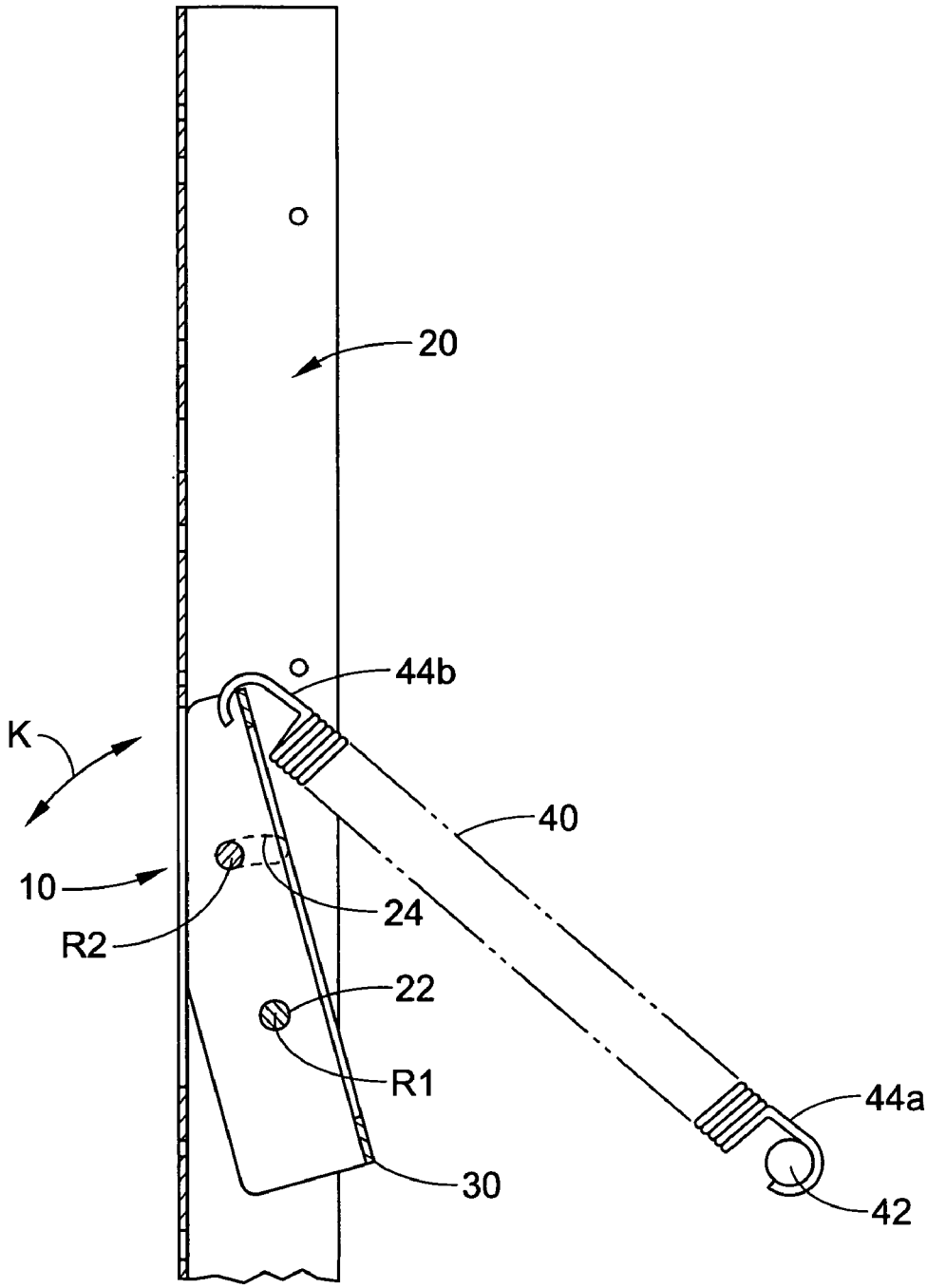
Figure 2C:
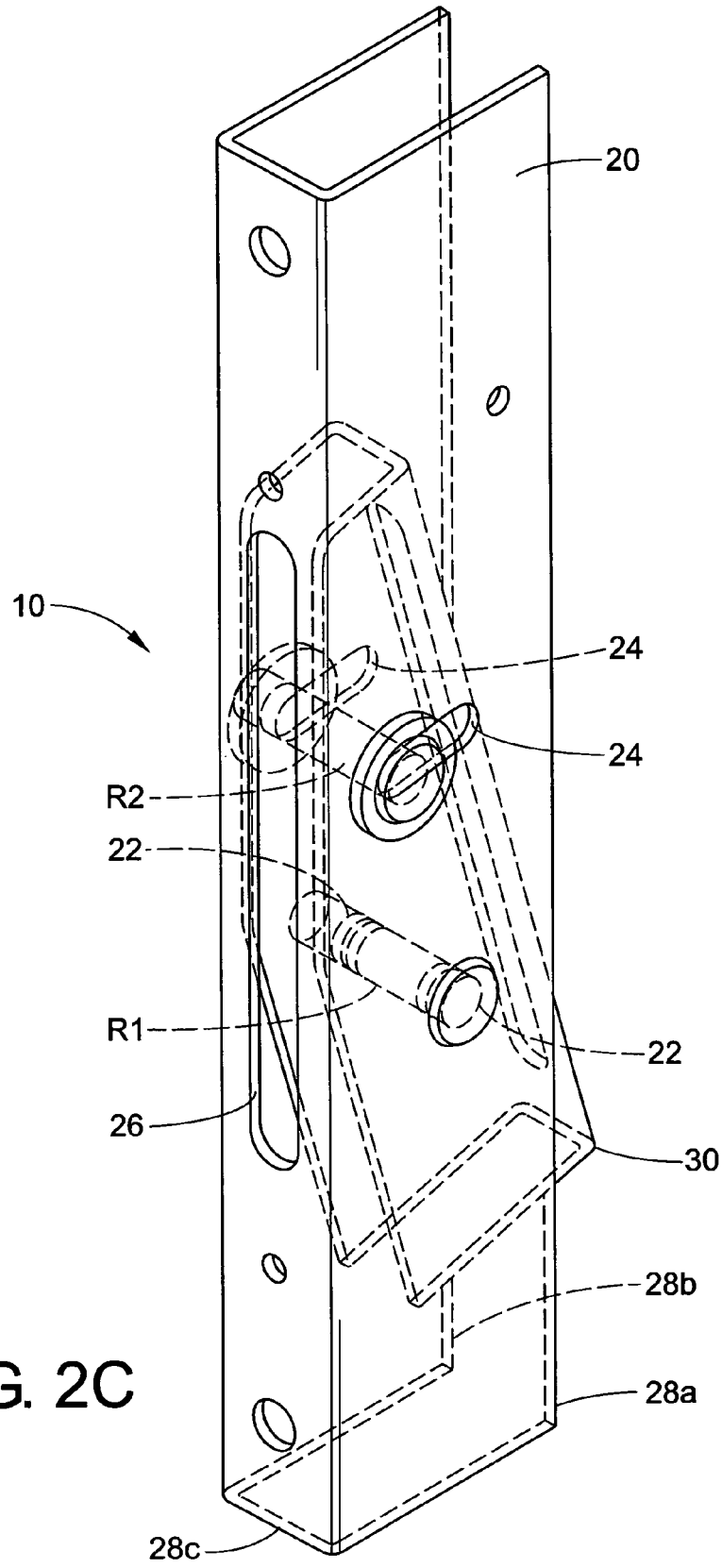

Turning now to FIGS. 2A–2C, a pivoting receptacle assembly formed in accordance with the present invention is shown generally at 10. The receptacle assembly 10 comprises a support member 20 and a second member, also referred to herein as a pivoting member or a pocket member 30, pivotally secured to the support member 20. The support member 20 can be a part of an appliance chassis. As shown herein, however, the support member 20 is a U-shaped channel defined from metal or another suitable material such as a polymeric material (see also FIGS. 7A–7C), and the support member 20 is fixedly secured to an appliance chassis via fasteners, welding and/or other suitable means. The invention is intended to encompass either type of support member.

Figure 7C:
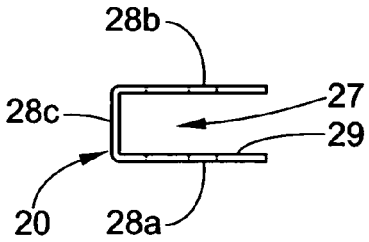
FIGS. 7A–7C show side elevational, rear elevational and top plan views, respectively, of a channel support member of the pivoting receptacle assembly shown in FIGS. 2A–2C; and, FIGS. 8A–8C show side elevational, rear elevational and top plan views, respectively, of an alternative embodiment of a pivoting hinge receptacle formed in accordance with the present invention.
Figure 7A:
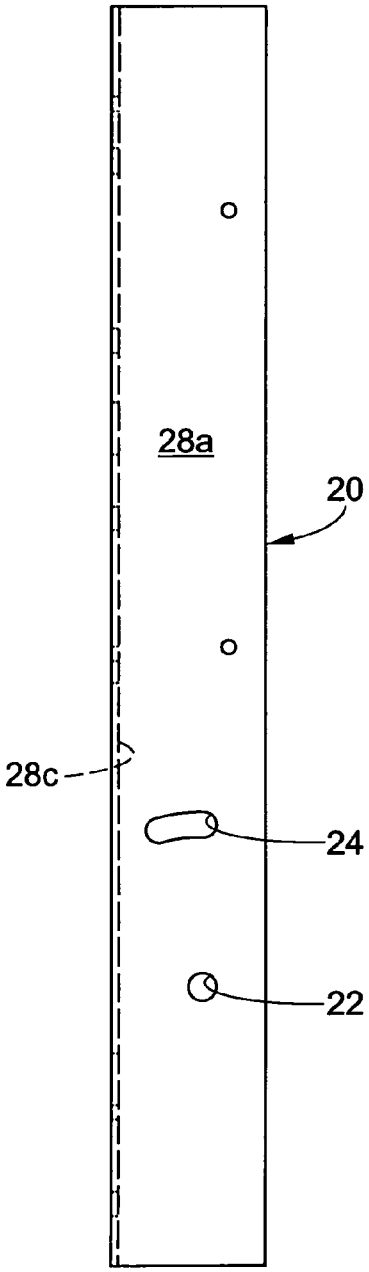

FIG. 7A shows the support member 20 in a side elevational view, and the opposite side is preferably a mirror image. It can be seen that the support member defines a first mounting location 22 and a second mounting location 24. In the illustrated embodiment, the first mounting locating is defined by a pair of aligned spaced-apart circular apertures, and the second mounting location is defined by a pair of aligned spaced-apart elongated or kidney-shaped apertures. As shown in FIG. 7C, the support member 20 has an overall U-shaped configuration defining a recess 27 between the opposite sidewalls 28*a*,28*b* and an inner wall 28*c*. An open mouth 29 to the recess 27 is defined between the sidewalls 28*a*,28*b*.

The second member or pocket member 30 is shown in FIGS. 6A–6C. The pocket member 30 is preferably also defined as a U-shaped metal stamping. FIG. 6A is a side elevational view of the pocket member 30, and the opposite side is preferably a mirror image. A first pin-receiving location 32 is defined by a first pair of aligned, spaced-apart apertures, and a second pin-receiving location 34 is defined by a second pair of aligned, spaced-apart apertures. As shown in FIG. 6C, the pocket member 38 has an overall U-shaped configuration defining a recess 37 between opposite sidewalls 38*a*,38*b* and an inner wall 38*c*. An open mouth 39 to the recess 37 is defined between the sidewalls 38*a*,38*b*.

To assembly the receptacle assembly 10, the pocket member 30 is nested within the recess 27 of the support member 20 as best seen in FIGS. 2A–2C (again, solid lines are used for clarity), with the open mouth 39 of the pocket member 30 opposed to the open mouth 29 of the support member 20. A first hinge mounting structure R1 such as a pin, rivet or other pin-like, stud-like or other member (e.g., pin, bolt, fastener, stud, member, etc.) is inserted through the aligned apertures of the first pin-mounting location 22 and first pin-receiving location 32 of the support member 20 and pocket member 30, respectively. Likewise, a second hinge mounting structure R2 such as a pin, rivet or other pin-like or stud-like member (e.g., (pin, bolt, fastener, stud, member, etc.) is inserted through the aligned apertures of the second pin-mounting location 24 and second pin-receiving location 34 of the support member 20 and pocket member 30, respectively. The rivets or other hinge mounting structures or pins R1,R2 span the recess 27,37. As noted, the hinge mounting structures R1,R2 can comprise rivets, pins, studs screws, bolts and/or other suitable elongated members (not necessarily cylindrical) that are adapted for being engaged and retained by the claw B of an associated hinge assembly A. These hinge mounting structures R1,R2, regardless of their exact form, can also comprise rollers, bushings, sleeves, tabs and like members connected thereto. For convenience and ease of reading, the hinge mounting structures R1,R2 are typically referred to hereinbelow simply as hinge mounting pins R1,R2.

When so assembled, the pocket member 30 (including the second hinge mounting pin R2) is pivotable relative to the support member 20 about the first rivet or other hinge mounting pin R2 on an arc K between a first or home (non-pivoted) position as shown in FIG. 2A to a second (pivoted) position as shown in FIGS. 2B and 2C. Pivoting movement of the pocket member 30 relative to the support member 20 on the arc K is limited by the extent of the apertures defining the second mounting location 24. Those of ordinary skill in the art will recognize that while the pocket member 30 (including the second hinge mounting member R2) pivots relative to the support member 20 about the first hinge mounting pin R1 on the arc K, the distance between the first and second hinge mounting pins R1,R2 is fixed.

With continuing reference to FIGS. 2A and 2B, the receptacle assembly 10 further comprises biasing means for biasing the pocket member 30 and second hinge mounting pin R2 into the first or home (non-pivoted) position as shown in FIG. 2A. In the illustrated embodiment, the receptacle assembly comprises a coil spring 40 operably connected between the pocket member and an anchor point 42 provided by the chassis of the oven or other appliance. The anchor point 42 can also be provided by the support member 20. In the illustrated embodiment, the spring 40 comprises first and second hooks 44*a*,44*b* at its opposite ends, and the first hook 44*a* is connected to the anchor point 42 while the second hook is connected to the pocket member 30 at a point where the spring 40 will bias the pocket member and hinge mounting pin R2 into the first, non-pivoted position. As shown in FIG. 2B, the pocket member 30 can be pivoted to its second position by application of sufficient pivoting force (also referred to herein as breakaway force) to overcome the biasing force of the spring 40 so that the spring 40 elongates. The spring 40 contracts or shortens and urges the pocket member 30 back to its home position when the breakaway force subsides.

Figure 4:
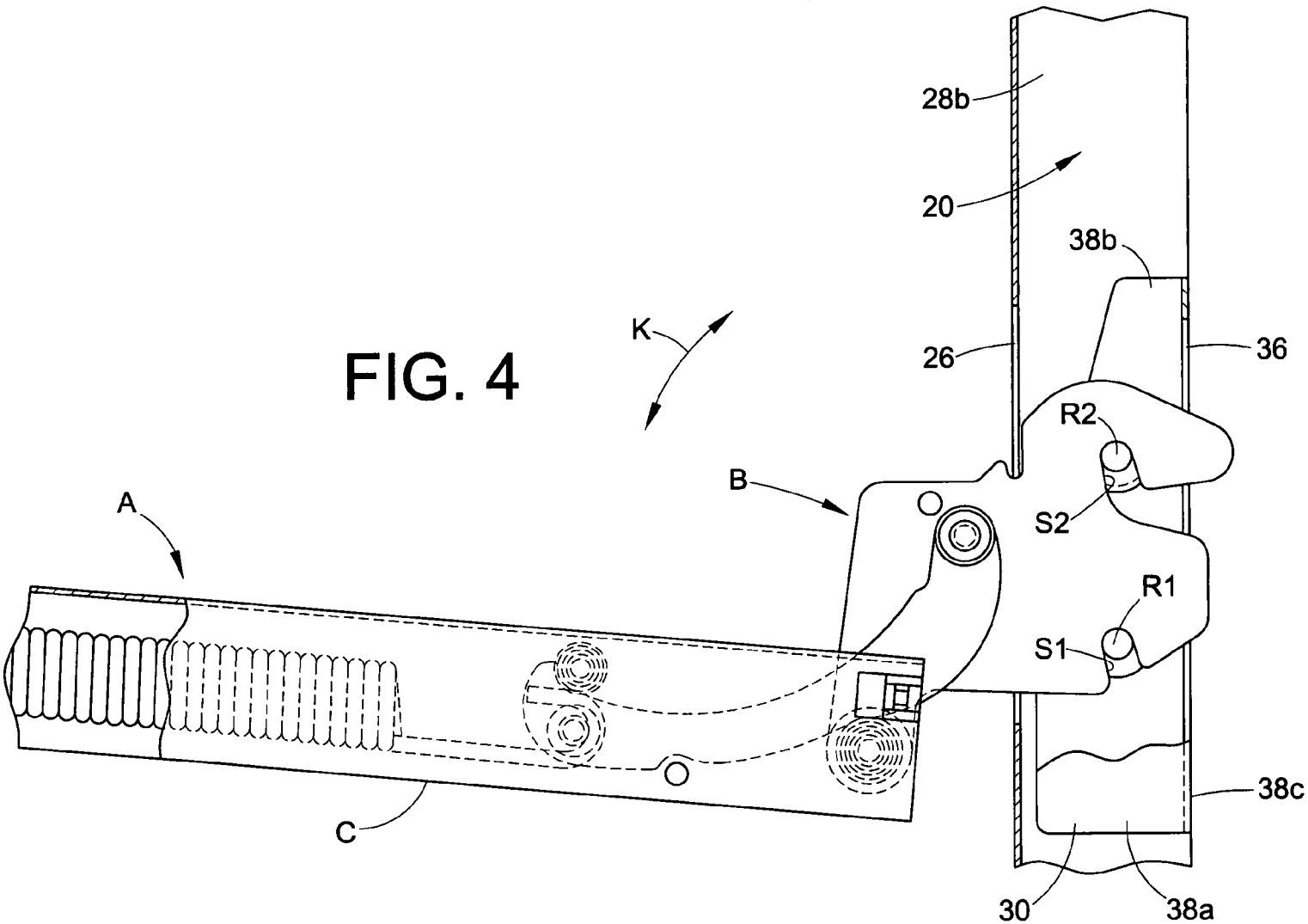
FIG. 4 illustrates the hinge assembly and receptacle assembly of FIG. 3A, with portions of the receptacle assembly broken away.
Figure 7B:
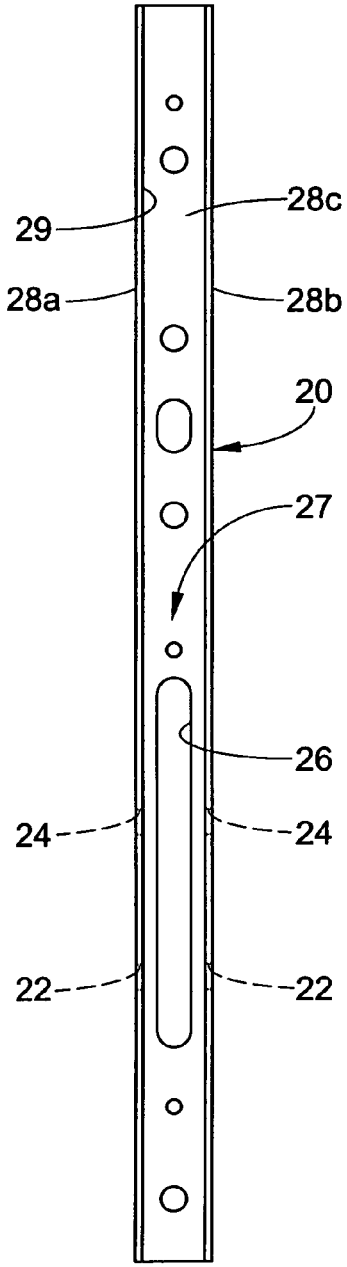

FIG. 4 shows a conventional hinge assembly A operably connected to the receptacle assembly 10 in accordance with the present invention. The portion of each rivet, pin or other hinge mounting structure R1,R2 located between the pocket member sidewalls 38*a*,38*b* is received and retained in the slots S1,S2 of the claw B, respectively. As also shown in FIGS. 2C and 7B, the support member 20 defines an opening or slot 26 in its inner wall 28*c* opposite the open mouth 27 and through which the claw B of an associated hinge assembly A is inserted so that the rivets or other hinge mounting pins R1,R2 are received in the slots S1,S2 of the claw B, respectively. The U-shaped conformation of the support member 20 also facilitates insertion of the claw B through the slot 26 without interfering contact between the claw B and the support member 20. As shown separately in FIGS. 6A–6C, the pocket member 30, itself, is also conformed and arranged to allow the hinge mounting pins R1,R2 to be respectively received in the slots S1,S2 of the claw B and so that it does not interfere with the claw B when the hinge mounting pins R1,R2 are received in the slots S1,S2. The U-shaped nature of the pocket member 30 combined with a slot 36 defined in is inner wall opposite the mouth 37, allow the hinge mounting pins R1,R2 to be respectively received in the slots S1,S2 of the claw B without interfering contact between the claw B and the support member 20 and/or pocket member 30. Typically, as shown, a portion of the claw B will extend entirely through the support member 20 and pocket member 30 via slots 26,36 when the claw B is operably coupled to the hinge mounting pins R1,R2 of the receptacle assembly 10.

Figure 3A:
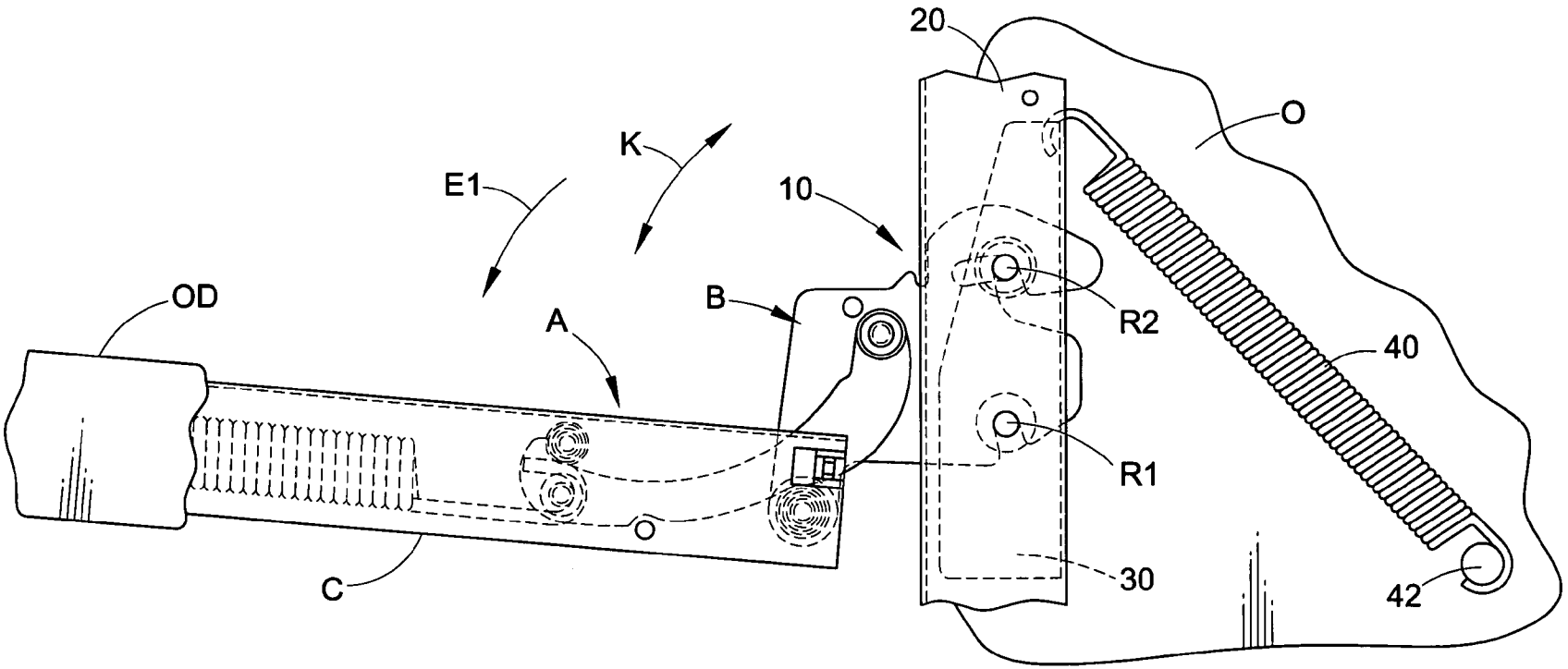
FIGS. 3A and 3B illustrate the conventional hinge assembly of FIG. 1 operably connected to the pivoting hinge receptacle assembly of the present invention, with FIG. 3A showing the receptacle assembly in the first or home position and FIG. 3B showing the receptacle assembly in the second (pivoted) position.
Figure 3B:
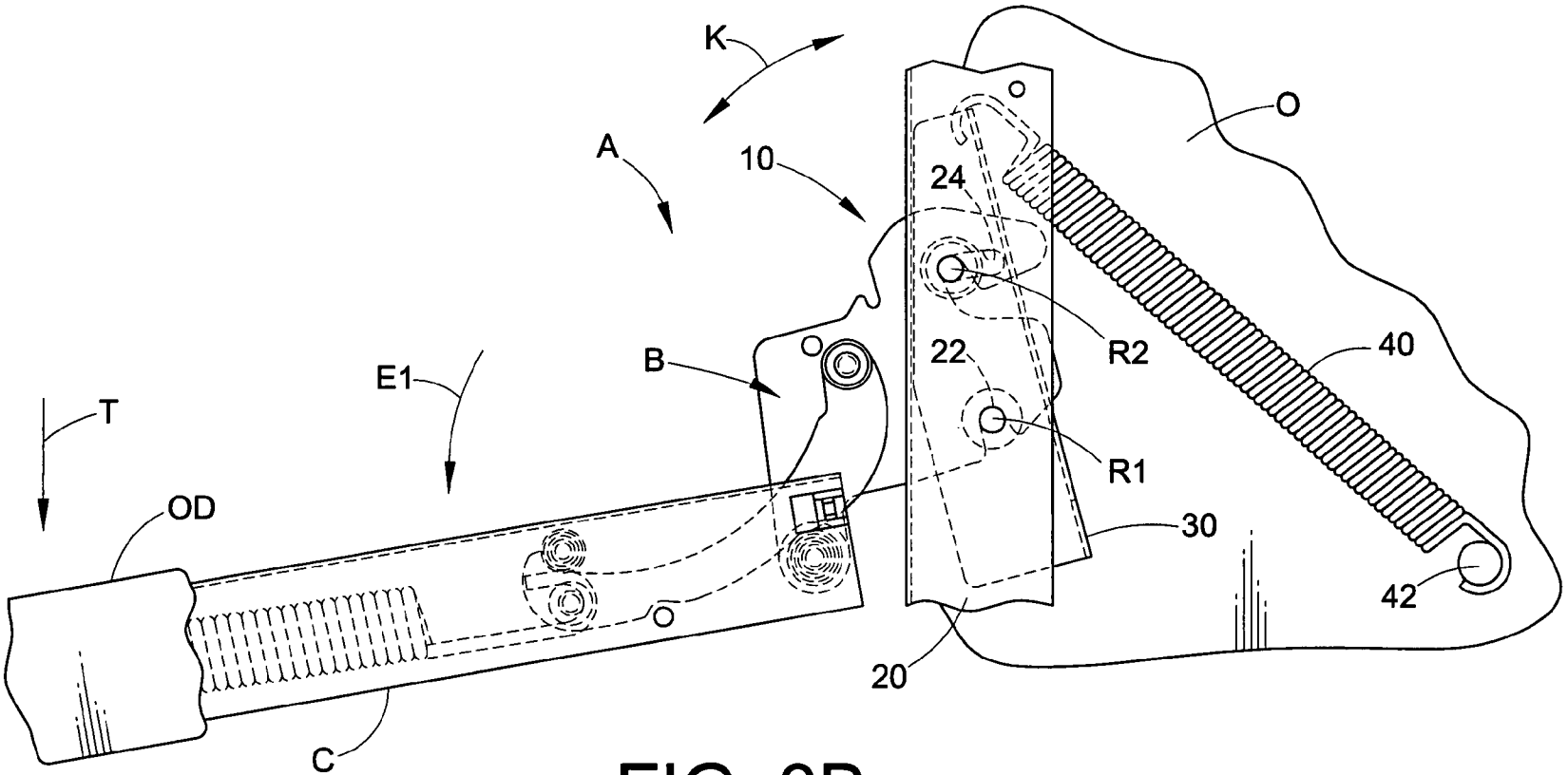

FIGS. 3A and 3B also show a conventional hinge assembly A operably coupled to the receptacle assembly 10 so as to pivotally connect an oven door OD to an oven chassis O. Typically, two hinge assemblies A are used for such an application and, thus, each would be connected to the oven chassis O by a separate receptacle assembly 10. With reference to FIG. 3A, the channel C of the hinge assembly A is shown in its first operative position corresponding to a fully-opened position of a door OD connected to the channel member C, i.e., attempted further movement of the channel member C in the direction E1 with sufficient force will result in damage to the hinge assembly A and/or tipping of the appliance such as the oven O to which the support member 20 is connected. According to the present invention, with reference now to FIG. 3B, application of sufficient breakaway force T to the channel C of the hinge assembly A in the direction E1 (via oven door OD or the like to which the channel C is connected) results in pivoting movement of the pocket member 30 about the first hinge mounting rivet, pin or other mounting structure R1 on the arc K against the biasing force of spring 40 from its first (non-pivoted) operative position to the second operative position shown in FIG. 3B. This pivoting movement of the pocket member 30 allows at least some of the force T to be absorbed by movement of the pocket member 30 against the biasing force of spring 40 so as to prevent damage to the hinge assembly A and/or tipping of the appliance O. Upon removal or subsiding of the force T, the spring 40 biases the pocket member 30 (with the hinge assembly A operably connected thereto) back to its home position as shown in FIG. 3A. The exact strength of the spring 40 will vary depending upon the arrangement of same, the particular hinge assemblies A being used to support the door OD, the weight of the door OD, the strength of the hinge assemblies A, and other variables. In general, however, the spring 40 should be selected for each application to ensure that the pocket member 30 remains in its first (non-pivoted) position until force T of sufficient magnitude is applied to the door OD as could lead to damage to door OD, hinge assemblies A and/or tipping of the appliance O, at which time the biasing force of the spring will be overcome and the pocket member 30 and hinge mounting member R2 will move toward to the second position to prevent these undesired consequences.

Figure 5:
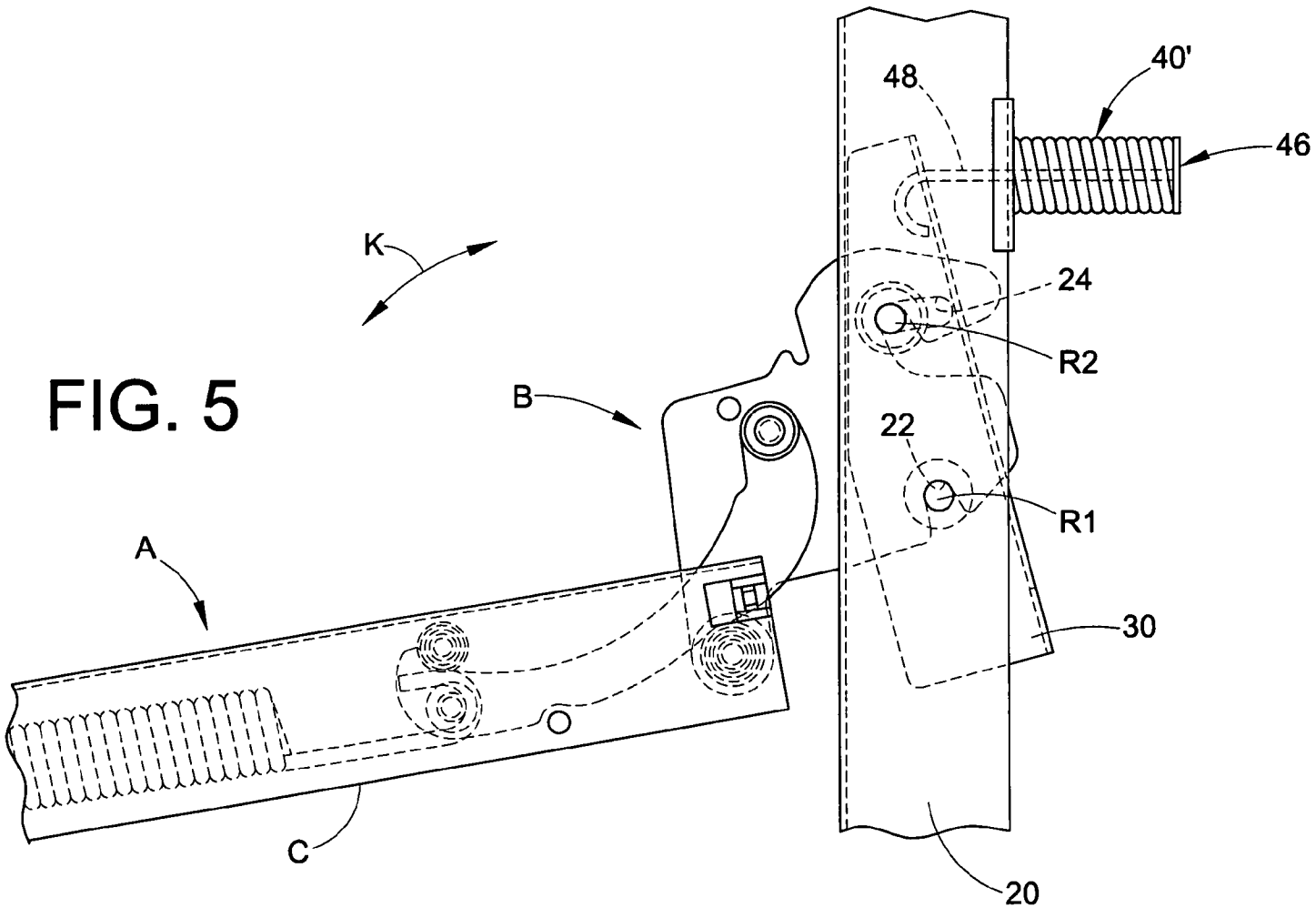
FIG. 5 illustrates a pivoting receptacle assembly formed in accordance with an alternative embodiment of the present invention.

FIG. 5 illustrates an alternative embodiment of the receptacle assembly 10' that is identical in all respects to the receptacle 10, except that the tension spring 40 is replaced by a compression spring 40'. The spring 40' is a coil spring abutted with the support member 20 and includes a head member 46 including a shank 48 that connects to the pocket member 30. When the pocket member 30 pivots as shown, the head 46 is pulled therewith by the shank 48 so that spring 40' is compressed by the head 46. When the pivoting force subsides, the spring 40' decompresses and elongates so that the pocket member 30 is once again biased into its home or non-pivoted position.

Although as described herein, the rivet or other hinge mounting pin R1 serves to pivotally interconnect the second (pocket) member 30 to the support member 20, those of ordinary skill in the art will recognize that other means can be used to pivotally interconnected the members 20,30. In one such case, both hinge mounting pins R1,R2 can be connected to and movable with the pocket member 30 relative to the support member 20. In another case, the first hinge mounting pin R1 can be entirely separate from and unassociated with the pocket member 30. Also, while the invention has been described with reference to use of two hinge mounting pins R1,R2, more or less can be used without departing from the overall scope and intent of the present invention, as long as at least one movable pin R2 is provided. Furthermore, the relative position of the first and second hinge mounting pins R1,R2 can be reversed without departing from the present invention, i.e., the first hinge mounting pin R1 can be located above the second hinge mounting pin R2.

Figure 8C:
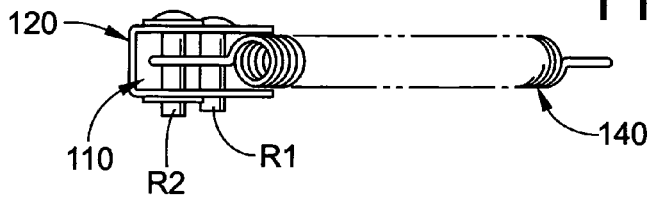
Figure 8A:
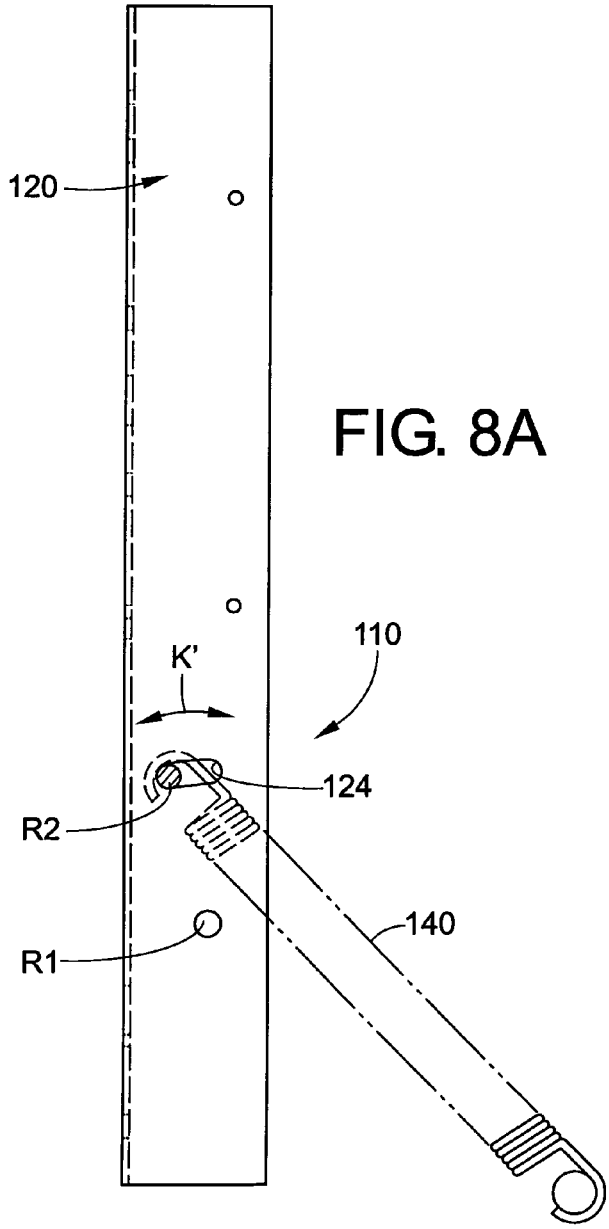
Figure 8B:
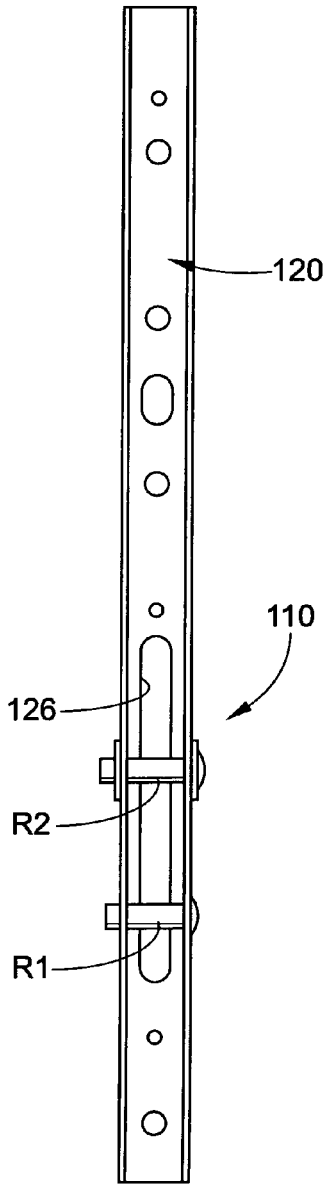

FIGS. 8A–8C illustrate an alternative pivoting hinge receptacle 110 formed in accordance with the present invention. Except as otherwise shown and described, the receptacle 110 is identical to the receptacle 10 and like reference numerals that are one-hundred (100) greater than those used above are used to identify similar components relative to the receptacle 10. In the receptacle 110, the pocket member 30 is omitted. At least the second rivet or other hinge mounting pin R2 is connected directly to the support member 120. The second hinge mounting pin R2 is slidably movable to and from the first and second positions in the elongated slots defining the second mounting location 124 as indicated by the arrow K'. A spring 140 (shown only in FIGS. 8A and 8C for clarity) extends between the second hinge mounting pin R2 and the chassis of the oven or another point and biases the second hinge mounting pin R2 into the first operative position. The second hinge mounting pin R2 slides in the slots defining the second mounting location 124 to the second position when sufficient breakaway force is exerted on the mounting pin R2 to overcome the biasing force of the spring 140. Of course, when the breakaway force subsides, the spring 140 biases the mounting pin R2 back to its home (first) position (the pin R2 is shown in its second position only).

While the invention has been described with reference to preferred embodiments, modifications and alterations will occur to those of ordinary skill in the art to which the invention pertains. It is intended that the following claims be construed literally and/or according to the doctrine of equivalents so as to encompass all such modifications and alterations.

Having thus described the preferred embodiments, what is claimed is:

1. A receptacle for mounting a hinge assembly to an appliance, said receptacle comprising:

a support member defining a recess between first and second sidewalls, wherein said first and second sidewalls comprise respective elongated slots located on opposite sides of said recess and aligned with each other;

a pivoting member nested in said recess between said first and second sidewalls of said support member and pivotally connected to said support member by a first hinge mounting structure that spans the recess of the support member, said pivoting member adapted for movement relative to said support member pivotally on an arc about said first hinge mounting structure between a first position and a second position;

a second hinge mounting structure that is inserted through and slidably located in said elongated slots of said support member and the spans the recess of the support member, said second hinge mounting structure also connected to the pivoting member for movement therewith relative to said support member pivotally about said first hinge mounting structure, wherein said first and second hinge mounting structures are adapted to be releasably engaged by a claw of an associated hinge assembly for releasable connection of the associated hinge assembly to said receptacle; and, a spring that normally biases said pivoting member and said second hinge mounting structure into said first position and that resiliently accommodates movement of said pivoting member and the second hinge mounting structure pivotally on said arc about said first hinge mounting structure to said second position under breakaway forces.

2. The receptacle as set forth in claim 1, wherein said first hinge mounting structure comprises at least one of a pin, stud, rivet or fastener, and wherein said second hinge mounting structure comprises at least one of a pin, stud, rivet or fastener.

3. The receptacle as set forth in claim 1, wherein said spring is a coil spring.

4. A receptacle for mounting a hinge assembly, said receptacle comprising:

a support member defining a recess between first and second spaced-apart opposing sidewalls;

a pivoting member connected to said support member and pivotably movable relative to said support member on an arc between first and second positions, wherein said pivoting member is movably nested within said recess of said support member between said first and second spaced-apart sidewalls;

a first hinge mounting pin that is connected to the first and second spaced-apart sidewalls of said support member, wherein said first hinge mounting pin spans said recess of said support member and extends through said pivoting member so as to pivotally connect said pivoting member to said support member;

a second hinge mounting pin that is slidably seated in respective first and second elongated slots defined respectively in said first and second spaced-apart sidewalls of said support member and that spans said recess and that also extends through said pivoting member so as to be connected to and movable with said pivoting member relative to said support member, wherein said first and second pins are adapted for releasably mating with a claw of an associated hinge; and, a spring that normally biases said pivoting member into its first position and that accommodates movement of said pivoting member to its second position.

5. The receptacle as set forth in claim 4, wherein said first and second hinge mounting pins comprise respective first and second rivets.

6. A breakaway hinge system for an appliance door, said system comprising:

a hinge assembly comprising a claw;

a receptacle adapted to receive and retain said claw of said hinge assembly, said receptacle comprising:

a support member defining a recess and an aligned pair of elongated apertures located on opposite sides of said recess;

a first hinge mounting member connected to said support member and spanning said recess;

a second hinge mounting member that spans said recess of said support member and that is slidably located in and extends between said pair of elongated apertures for movement within said pair of elongated apertures about said first hinge mounting member between first and second positions, wherein said claw of said hinge assembly is releasably engaged with said first and second hinge mounting members; and, a spring having a biasing force that biases said second hinge mounting member to said first operative position, wherein said second hinge mounting member is movable to said second position in response to application of force to said hinge assembly having a magnitude sufficient to overcome said biasing force of said spring.

7. The breakaway hinge system as set forth in claim 6, wherein said first hinge mounting member comprises one of a pin, rivet, stud or fastener and wherein said second hinge mounting member comprises one of a pin, rivet, stud or fastener.

8. The breakaway hinge system as set forth in claim 7, wherein said receptacle comprises a pivoting member and wherein said first hinge mounting member pivotally connects said pivoting member to said support member and wherein said second hinge mounting member is connected to and moves with said pivoting member on an arc about said first hinge mounting member.

9. The breakaway hinge system as set forth in claim 8, wherein said pivoting member is nested within said recess of said support member.

10. A breakaway hinge system far an appliance door, said system comprising:

a support member fixedly secured to an appliance chassis and defining a recess between first and second spaced-apart sidewalls, said first and second sidewalls comprising respective first and second elongated slots that are aligned with each other on opposite sides of said recess;

a first hinge mounting structure connected to the first and second spaced-apart sidewalls of said support member and spanning said recess;

a second hinge mounting structure slidably located in said first and second aligned slots and spanning said recess between said first and second sidewalls of said support member and movable on an arc centered at said first hinge mounting structure between first and second positions, said first and second hinge mounting structures adapted to be engaged and releasably retained by associated hinge assembly; and, a spring that biases said second hinge mounting structure to said first position, said second hinge mounting structure selectively movable on said arc within said first and second elongated slots to said second position against said biasing force of said spring.

11. A receptacle for mounting a hinge assembly to an appliance, said receptacle comprising:

a support member;

first and second hinge mounting structures each comprising a pin, rivet, stud or fastener adapted to be engaged by a claw of an associated hinge assembly, said first hinge mounting structure secured to said support member in a fixed location and said second hinge mounting structure spanning a recess defined between spaced-apart first and second sidewalls of said support member and comprising opposite first and second ends slidably positioned in first and second slots defined respectively in said first and second spaced-apart sidewalls, wherein said second hinge mounting structure is movable in said first and second slots between first and second positions relative to said first hinge mounting structure, and wherein said second hinge mounting structure is connected to a pivoting member defined separately from and nested between said first and second spaced-apart sidewalls of said support member, wherein pivoting member is pivotally connected to said support structure by said first hinge mounting structure; and, a spring for biasing said second hinge mounting structure toward said first position, said second hinge mounting structure movable from said first position toward said second position when a breakaway force is applied to the associated hinge assembly sufficient to overcome a biasing force of said spring.

12. The receptacle as set forth in claim 11, wherein said second mounting structure moves on a circular arc section about a pivot point defined by said first mounting structure so that a distance between said first and second mounting structures is constant when said second mounting structure moves from said first position to said second position.

* * * * *